US006955496B2

(12) United States Patent
Burchell

(10) Patent No.: US 6,955,496 B2
(45) Date of Patent: Oct. 18, 2005

(54) ROAD MARKER

(76) Inventor: Shaun Burchell, 30 Itogen Road, Selcourt 1559 (ZA)

( * ) Notice: Subject to any disclaimer, the term of this patent is extended or adjusted under 35 U.S.C. 154(b) by 24 days.

(21) Appl. No.: 10/477,808

(22) PCT Filed: Dec. 7, 2001

(86) PCT No.: PCT/IB01/02334

§ 371 (c)(1),
(2), (4) Date: May 13, 2004

(87) PCT Pub. No.: WO02/092915

PCT Pub. Date: Nov. 21, 2002

(65) Prior Publication Data

US 2004/0184881 A1 Sep. 23, 2004

(30) Foreign Application Priority Data

May 16, 2001 (ZA) ..... 2001/3994
Aug. 23, 2001 (ZA) ..... 2001/6976

(51) Int. Cl.[7] ..... E01F 9/07
(52) U.S. Cl. ..... 404/10; 404/16; 116/63 R
(58) Field of Search ..... 404/9–16; 116/63 R, 116/63 P

(56) References Cited

U.S. PATENT DOCUMENTS 3,216,335 A 11/1965 Stolarczyk et al.
3,924,958 A * 12/1975 Rowland ..... 404/15
4,234,264 A * 11/1980 Baldi ..... 404/11
4,297,051 A 10/1981 Robinson
4,595,312 A * 6/1986 Corless ..... 404/11
4,955,982 A * 9/1990 Paulos ..... 404/11
5,069,577 A * 12/1991 Murphy ..... 404/11
5,302,048 A * 4/1994 Paulos et al. ..... 404/11
5,425,596 A 6/1995 Steere et al.
5,857,801 A * 1/1999 Brown ..... 404/11
5,895,170 A * 4/1999 Chambers et al. ..... 404/10

FOREIGN PATENT DOCUMENTS

DE 25 22 935 A 12/1976
GB 2136859 A * 9/1984 ..... B60Q/7/00

* cited by examiner

*Primary Examiner*—Robert E. Pezzuto
*Assistant Examiner*—Alexandra K. Pechhold
(74) *Attorney, Agent, or Firm*—Marshall & Melhorn, LLC

(57) ABSTRACT

A reflective road marker (10, 48) to be mounted on a road surface to indicate the position of traffic control lines on that surface. The road marker has a base (14, 62) which can be secured to the road surface by adhesive. An resilient support (20, 50) is secured to the base and supports light reflectors (24, 68) at an acute angle to the road surface. The support allows the reflectors to be deflected resiliently towards the base in response to passage of a vehicle tyre over the road marker. To prevent damage to the reflectors means is provided to prevent ingress of solid particles between the reflector and the base. In the preferred embodiment, the support is provided by a hollow diaphragm of a resilient material.

9 Claims, 8 Drawing Sheets

ROAD MARKER

BACKGROUND TO THE INVENTION

THIS invention relates to a road marker.

The invention is particularly concerned with a road marker of the kind which is mounted on a traffic control line on a road surface. Such road markers include a reflector to reflect light from approaching vehicle headlights back towards the vehicle driver, thereby to indicate clearly the position of the line to the driver.

Different types of road marker are known and used. A currently popular road marker has a base which is sunk in a preformed cavity in the road surface, and adhered there by adhesive, and a rigid upper reflector exposed above the road surface and encapsulated in tough glass. While such road markers are popular they are expensive to manufacture and install. Another popular and somewhat less expensive road marker has a rigid plastics frame holding the reflector above a flat base which is stuck directly to the road surface by adhesive. The problem here is that such road markers are frequently dislodged from the road surface by the impacts applied to them by vehicle tyres, and hence have to be replaced frequently.

SUMMARY OF THE INVENTION

According to the invention there is provided a road marker comprising a base which can be secured to a road surface and resilient support means secured to the base and supporting at least one light reflector at an acute angle to the road surface in a manner allowing the reflector to be deflected resiliently towards the base in response to passage of a vehicle tyre over the road marker, and means to prevent ingress of solid particles between the reflector and the base.

In the preferred embodiments, the support means comprises, for each reflector, at least one resilient, hollow diaphragm made of elastomeric material and having an opening therein in which the reflector is mounted. Most preferably the diaphragm has an open bottom, spaced apart front and rear walls and spaced apart side walls, the front, rear and side walls defining an upwardly tapering hollow structure and the front wall having the opening therein in which the reflector is mounted, the front, rear and side walls, the hollow structure being located on and secured to the base to prevent ingress of solid particles between the reflector and the base.

Other preferred features of the invention are set forth in the appended claims.

BRIEF DESCRIPTION OF THE DRAWINGS

The invention will now be described in more detail, by way of example only, with reference to the accompanying drawings in which.

DESCRIPTION OF THE ILLUSTRATED EMBODIMENTS

Figure 1:
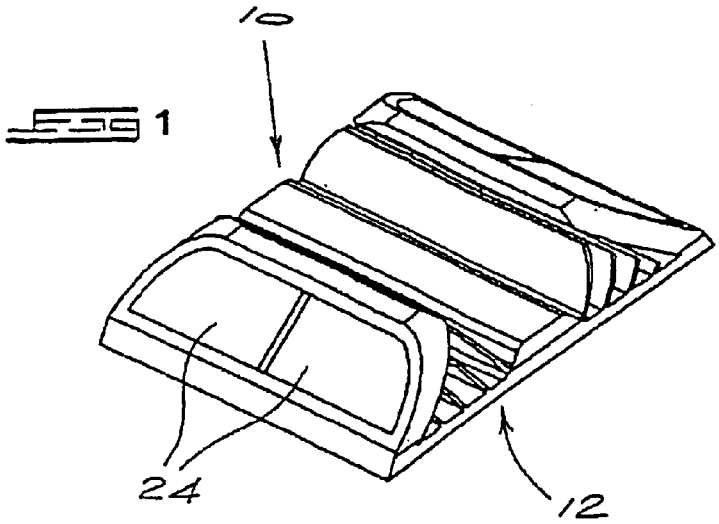
FIG. 1 shows a perspective view of a road marker according to a first embodiment of the invention.
Figure 2:
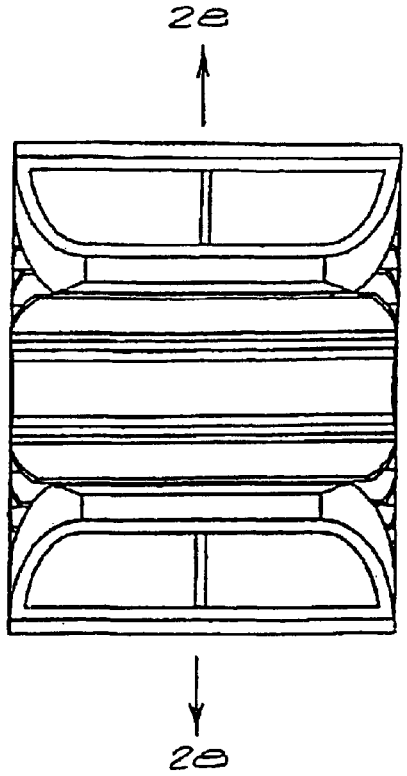
FIG. 2 shows a plan view of the road marker of FIG. 1.
Figure 3:
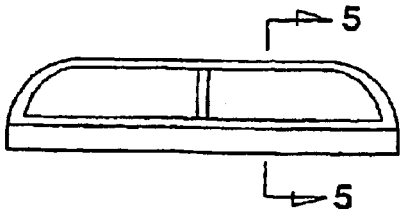
FIG. 3 shows an end view of the road marker seen in FIG. 1.

FIGS. 1 to 4 illustrate a first embodiment of the invention. The road marker 10 shown here includes an elastomeric body 12 moulded in one piece of a suitably tough and resilient silicone rubber. The body 12 has a rectangular base 14 with a flat underside 16, and an upper surface which includes a central upstanding rib 18. In addition, the body 12 includes a support means comprising a pair of support formations each in the form of an arm 20. As illustrated, the arms 20 extend upwardly from the base, in a direction towards one another, at an acute angle to the base. Extending from the base towards the underside of each arm 20 are four parallel, slender webs 22.

Figure 4:
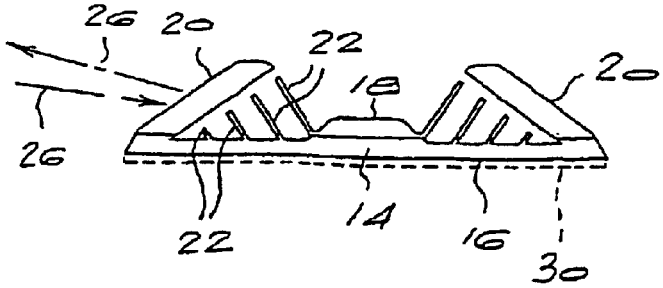
FIG. 4 shows a side view of the road marker seen in FIG. 1.

Each arm 20 serves to support a pair of reflectors 24 arranged side by side. The reflectors are designed to receive and reflect light generally horizontally, in opposite directions, as indicated in FIG. 4 by the arrows 26. More will be said below about different types of reflector which can be used and the manner in which such reflectors can be mounted to the arms 20.

In use a suitable adhesive, typically a silicone-based adhesive, is applied to the underside 16 of the base 14 and the base is adhered to a road surface, typically on a traffic control line. The line is not illustrated in the drawings but it will be understood that it will extend in the direction indicated in FIG. 2 by the arrows 28. Instead of an adhesive separately applied to the base, it is within the scope of the invention for the underside 16 of the base 14 to carry an adhesive-bearing tape indicated diagrammatically by the numeral 30 in FIG. 4. This tape, which is applied to the road marker in the factory, is covered by a protective, peel-off film. On site, the film is peeled off to expose the tape which is then pressed down onto the road surface to achieve the desired adhesion.

Figure 6:
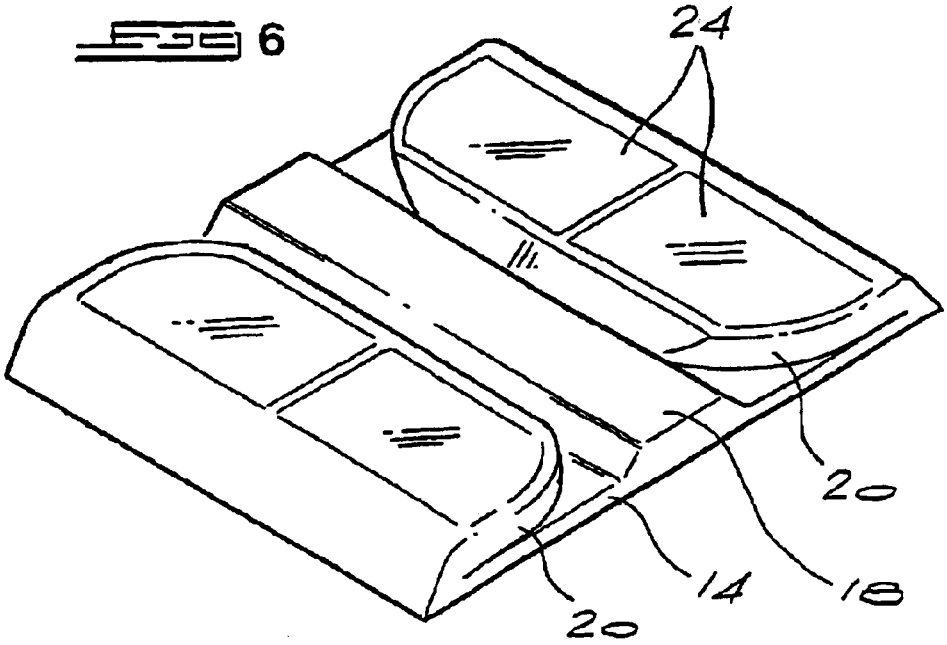
FIG. 6 shows how the support arms of the embodiment of FIGS. 1 to 4 can deflect resiliently when impacted.
Figure 7:
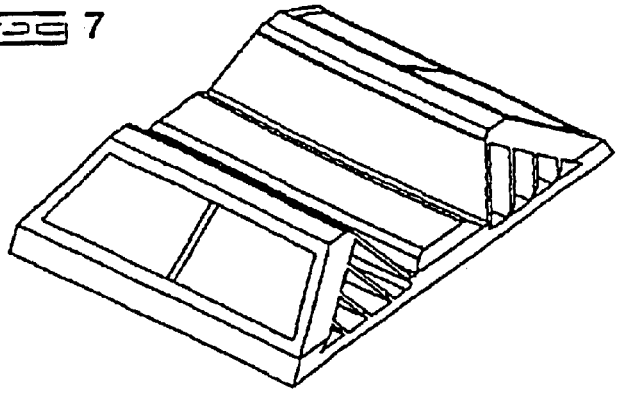
FIGS. 7 to 10 show views similar to FIGS. 1 to 4 of a second embodiment of the invention.
Figure 8:
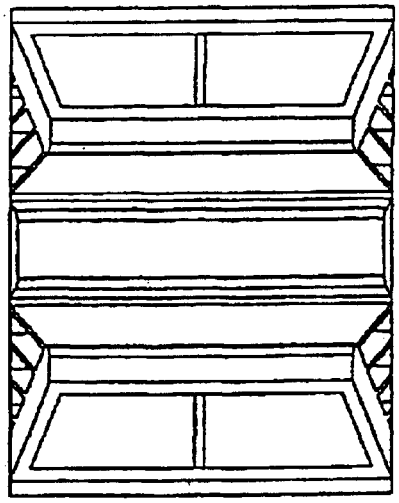
Figure 9:
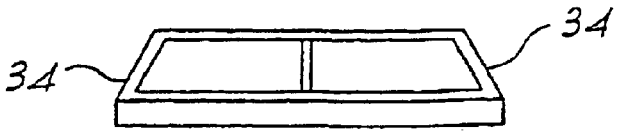
Figure 10:
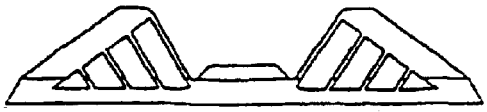
Figure 11:
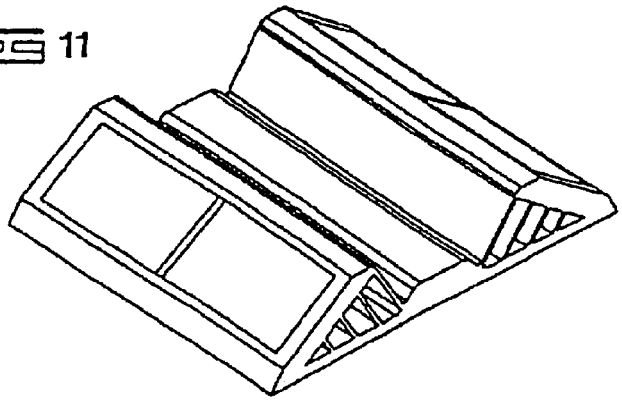
FIGS. 11 to 14 shows views similar to FIGS. 1 to 4 of a third embodiment of the invention.
Figure 12:
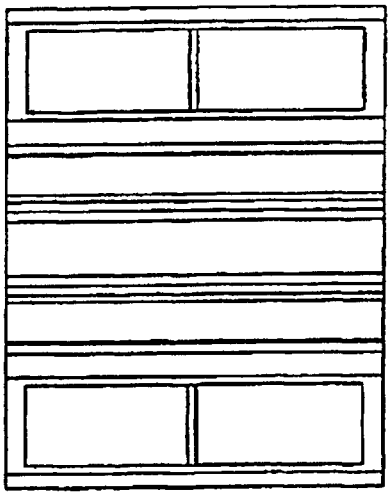
Figure 13:
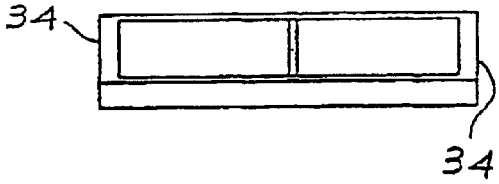
Figure 14:
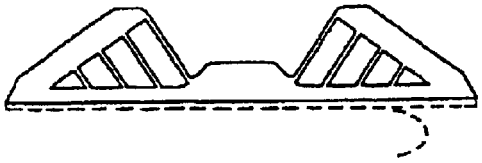

Once the road marker has been installed in this way on a road surface it will be subjected to frequent impacts and loads applied to it by the tyres of passing vehicles. If a tyre impacts on the road marker, the arms 14 will flex downwardly as shown in FIG. 6 such that the undersides of the arms are virtually flush with the upper surface of the base 14.

After the tyre has passed and the load is removed, the arms will flex back to their original positions as a result of the inherent resilience of the elastomeric body 12.

With a suitably tough grade of silicone rubber, it is anticipated that the arms of the road marker will be able to flex down and up virtually indefinitely without breaking or otherwise failing.

It is considered undesirable for large stones or other particles to lodge between an arm 20 and the base 14, since irreparable damage could then be caused to the arm and/or the base when next the arm, flexes downwardly in response to an applied load from a vehicle tyre. Another danger is that a large particle between an arm and the base could prevent the arm from flexing properly.

It is however considered acceptable for smaller stones or other particles to lie between the arms and the base, since such particles would merely form temporary impressions in the arms and/or the base without causing any permanent damage or interfering with the free flexure of the arms. The webs 22 serve to limit the size of any particle which might otherwise enter between the arms and the base. It will be understood that in practice the clear spacing between the webs is selected to allow only particles smaller than a predetermined size to enter. While serving the important function of excluding larger particles, the webs provide very little resistance to free flexure of the arms in response to applied loads.

A major advantage of the embodiment illustrated in FIGS. 1 to 6 is the ability of the arms to flex resiliently when impacted upon. When the arms are flexed downwardly as shown in FIG. 6 the road marker assumes a rather flat profile. The vehicle tyre can pass relatively easily over the flattened marker and there is therefore little longitudinal loading applied in the direction of vehicle movement and this, in combination with the inherent resilience of the road marker, means that the tendency for the road marker to be dislodged from the road surface is reduced compared to known road markers in which the reflector housing is rigid.

FIGS. 7 to 10 illustrate a second embodiment which differs from the first in that the sides 34 of the marker are straight and inclined to the vertical, when seen in end view, as opposed to curved. The third embodiment illustrated in FIGS. 11 to 14 differs from the other embodiments in that the sides 34 have no inclination or curvature in end view. It is however anticipated that the inclined and curved versions may be subjected to less destructive wear caused by passing traffic than the sharp-angled embodiment of FIGS. 11 to 14. The second and third embodiments also differ from the first embodiment in that the webs 24 are connected integrally to the underside of the arms 20 and extend to the base from there.

Figure 15:
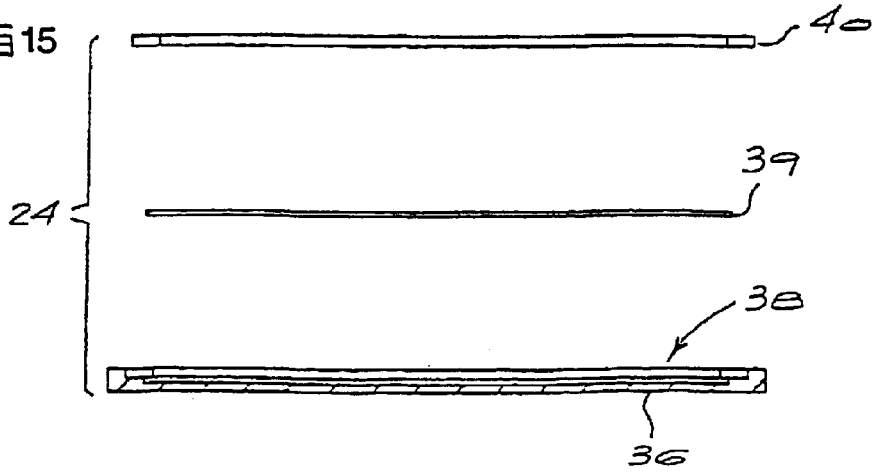
FIG. 15 shows an exploded side view of one version of reflector prior to assembly and installation in a road marker.

FIG. 15 illustrates one type of reflector which can be used in the road markers described above. There is a base 36 moulded in a suitably tough polycarbonate. The base includes an undercut recess 38 into which, during assembly, a strip 39 of reflective tape is slipped. The tape is then sealed in position by a clear polycarbonate lens 40 which mates with the base and is ultrasonically welded thereto.

Figure 5:
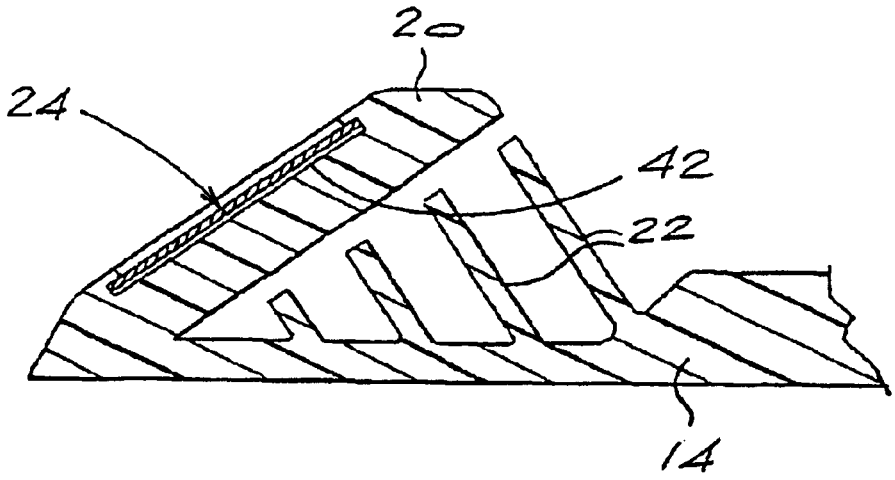
FIG. 5 shows a partial cross-section at the line 5—5 in FIG. 3.

In the embodiments described above, the outer or upper surfaces of the arms 20 are formed with undercut recesses 42 as exemplified in the detail of FIG. 5. Reflectors made in the manner described in the preceding paragraph are clipped into these recesses so that the reflective tape is exposed above the road surface to perform the required light reflecting action. To improve the resistance of the polycarbonate to scratching, a silicone film may be applied to the exposed reflector surface either after before or after installation of the reflector.

The reflector mounting arrangement just described has the advantage that the reflector can be replaced when necessary merely by prising it out of the recess 42 and clipping a new one in its place.

Many other reflector possibilities are within the scope of the invention. For instance, the body 12 could itself be made of a clear grade of silicone with the reflective tape merely embedded in the arms 20 during the moulding process. Alternatively, narrow cavities could be formed, during moulding, in the arms into which reflective strips could be slipped, the cavities subsequently being sealed off with a silicone sealant or the like. In each case, it will be understood that the reflective tape or other reflective material which is used is specifically designed to receive and reflect light in specific angular ranges, in each case to suit the specific orientation of the arms 20.

In the embodiments described above, there are two reflectors per arm 20. It is envisaged that this will promote further flexibility of the arms. Nevertheless It is quite possible for each arm to carry a single reflector only. It is also within the scope of the invention for these embodiments of road marker to have only a single arm. Such markers could find application in situations where motorists only need to see a road marker from one direction, eg on a one way road.

FIGS. 16 to 19 illustrate a fourth embodiment of the invention. This embodiment makes use of support means in the form of moulded elastomeric bodies 50, in this case of HYTREL™, a polyester resin product of E I du Pont de Nemours & Co, although other suitable elastomers are also within the scope of the invention. Each body 50 is moulded in one piece and includes a diaphragm 56 having a front wall 52 bounding an opening or aperture 54, side walls 58 and a rear wall 60. The body 50 has an open bottom and the front, rear and side walls in combination define an upwardly tapering, hollow diaphragm structure as illustrated.

The fourth embodiment has a separate base 62 moulded in one piece of a rigid polycarbonate. As illustrated, the base 62 includes a pair of openings 64 separated from one another by a central rib 66.

The fourth embodiment has reflectors 67 each of which includes a rigid, light transmitting polycarbonate front plate 68 and a rigid polycarbonate rear plate 74. The reflectors are mounted in the openings 54 of the diaphragm. The front plate 68 is formed with a peripheral undercut 70 that receives a rib 72 circumscribing the opening 54 and is anchored relative to the opening by the rear plate 74 which spans across the opening and which is ultrasonically welded to the front plate at the extremities of a peripheral rib 76 on that plate. The ribbed edge of the opening is therefore trapped securely between the front and rear plates and the reflector is permanently connected to the body 50.

Figure 19:
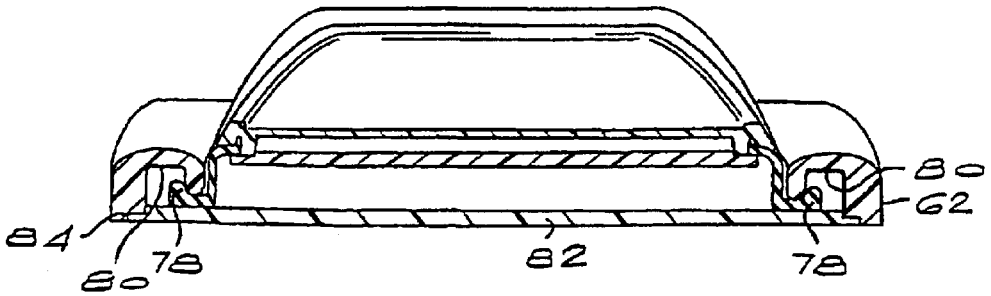
FIG. 19 shows a cross-section at the line 19—19 in FIG. 18.

The bodies 50 are secured to the base 62. The lower edges of the sides 58 carry ribbed flanges 78 which locate in undercut recesses 80 at the sides of the openings 64 in the base, as illustrated in FIG. 19. In each case, a rigid polycarbonate base backing plate 82 is then brought up against the underside of the base 62 such that its peripheral edge locates in a recess 84 where ultrasonic welding takes place. Although the flanges 78 are now trapped in the recesses 80, it will be seen that the recesses are wide enough to allow some lateral movement of the flanges when the diaphragms are depressed forcibly by a vehicle tyre as described below.

In use, the base backing plates and exposed areas of the underside of the base 62 are stuck permanently to the road surface by means of a suitable adhesive, typically an epoxy.

Although the side walls 58 and rear wall 60 of the diaphragms 56 are of thin cross-section, their resilience is sufficient to maintain the reflectors at the appropriate acute angle to perform the necessary road marking function. When a vehicle tyre passes over the road marker, the diaphragms will deform as necessary to allow the support formation to flex downwardly, as indicated by the arrows 90 in FIG. 18, so that the reflectors assume a generally horizontal attitude. After passage of the tyre the resilience of the diaphragm restores the reflectors to their normal operating orientation.

Figure 16:
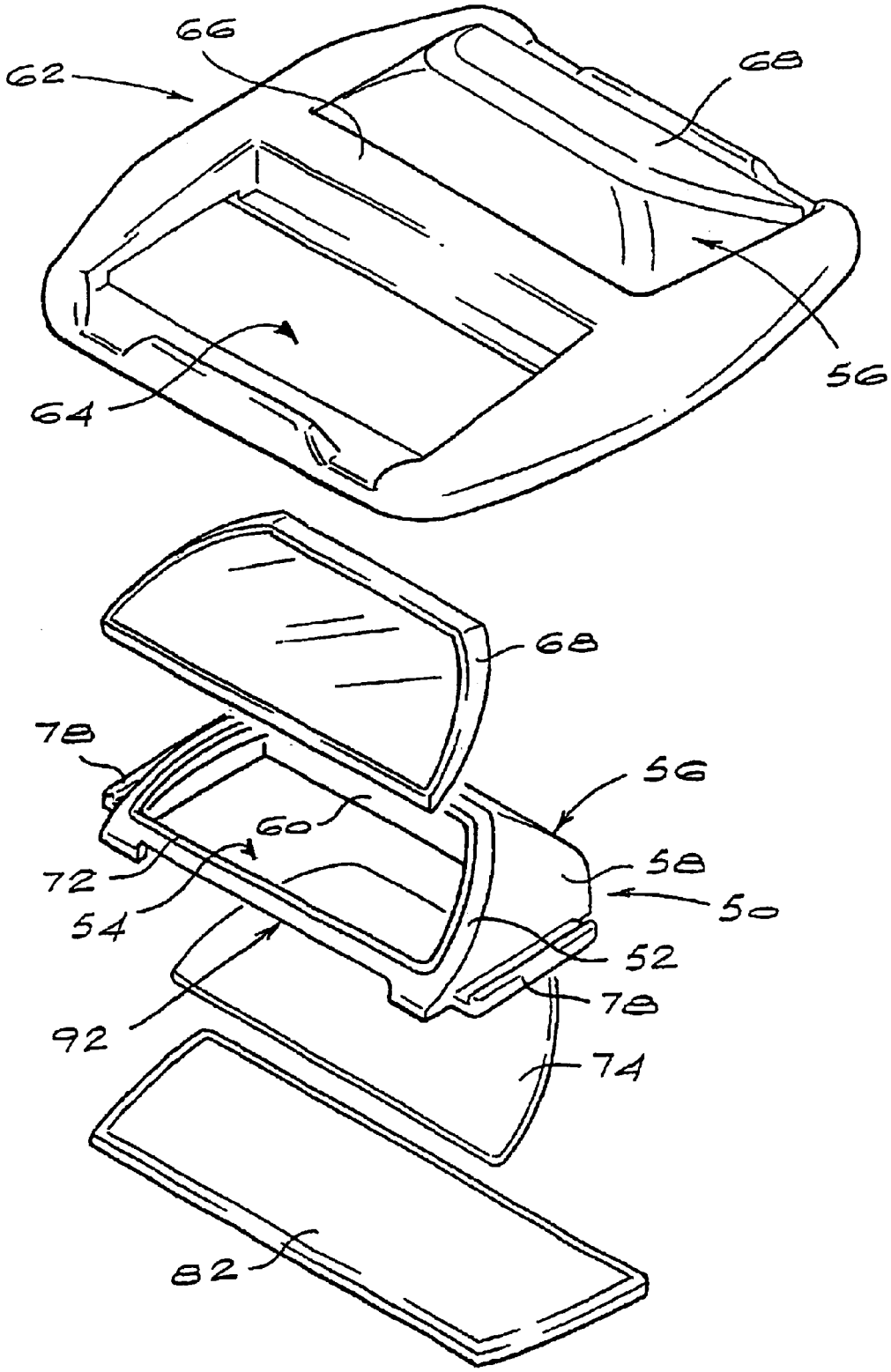
FIG. 16 shows an exploded, perspective view of a fourth embodiment of the invention.

Referring to FIG. 16 it will be noted that the leading edge of the front wall 52 is formed, beneath the aperture 54, with a rebate 92. When the body is depressed by passage of a vehicle tyre air therein will be exhausted through the rebate 92, thereby avoiding possible bursting of the diaphragm as a result of trapped air. The edges of the rebates are protected against damage by vehicle tyres by upstanding formations 94 at either end of the base 62.

Apart from their resilience function, the diaphragms 56 prevent ingress of stones or other larger particles beneath the support formations and reflectors.

FIGS. 20 to 23 illustrate a fifth embodiment which is similar in many respects to the fourth embodiment seen in FIGS. 16 to 19. Components corresponding to those seen in FIGS. 16 to 19 are designated with the same reference numerals.

The elastomeric bodies 50 in the fifth embodiment are once moulded in one piece of HYTREL™ (trade mark of E I de Pont de Nemours & Co). These bodies 50 are of substantially the same configuration as those in FIGS. 16 to 19.

Figure 22:
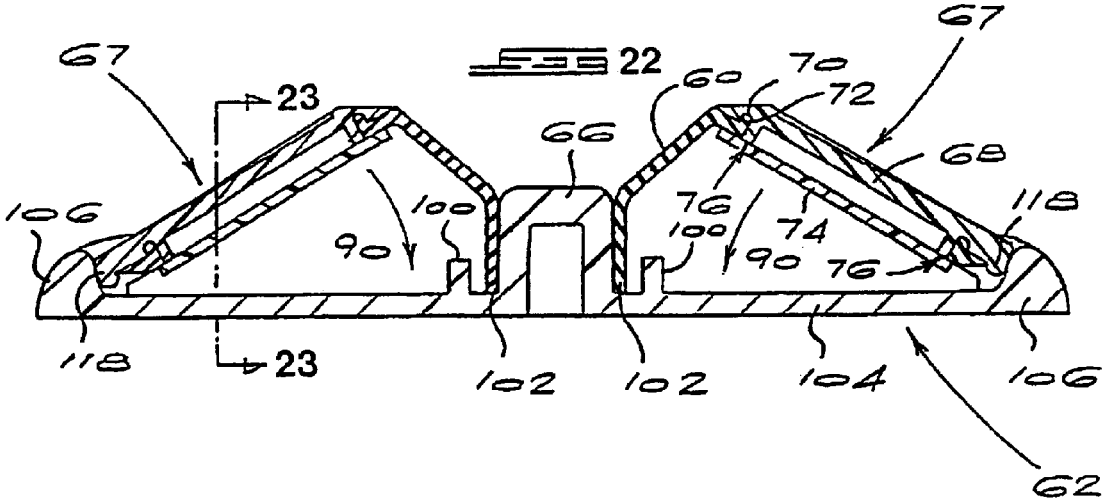
FIG. 22 shows a view similar to FIG. 18 of the fifth embodiment.

In the fifth embodiment, the base 62 is once again moulded in rigid polycarbonate and includes a pair of openings 64 separated from one another by a central rib 66. However in this case smaller ribs 100 lie alongside the central rib 66 with a small gap between each rib 100 and the rib 66. Referring to FIG. 22 it will be seen that when each body 50 is mounted on the base 62 a lower, vertically extending edge 102 of the rear wall 60 of the diaphragm locates between the ribs 60 and 100. The ribs reduce the possibility of the edge 102 bending or rolling over on itself when the diaphragm flexes in use.

In the embodiment of FIGS. 16 to 19, the openings 64 extend right through the base 62 and the underside of the base is closed by relatively large backing plates 82. In the embodiment of FIGS. 20 to 23, the openings 64 are largely closed by integral bottom walls 104 spanning between the central rib 60 and the upstanding ribs 106 at the ends of the base. Smaller openings 108 extend right through the base on either side of each of the bottom walls. During assembly of the road marker, each of the four openings 108 is closed by a rigid polycarbonate backing plate 110. The edges of each backing plate locate in a peripheral recess 112 bounding the opening 108 and the backing plates are, as before, ultrasonically welded in place to provide the base 62 with a continuous, flat bottom surface which can be stuck to the road surface using a suitable adhesive.

Figure 21:
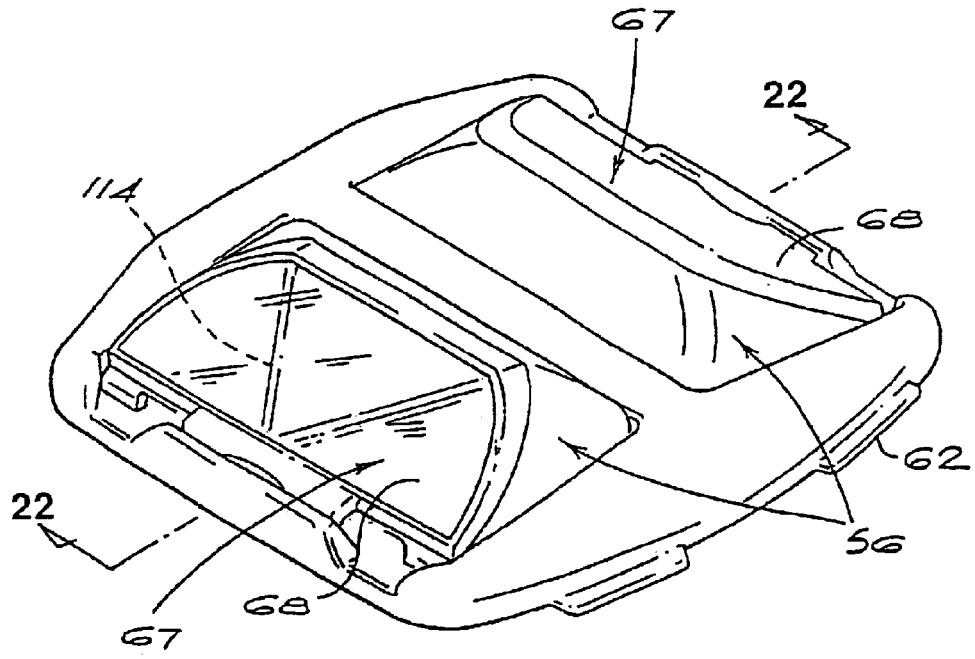
FIG. 21 shows a view similar to FIG. 17 of the fifth embodiment.
Figure 23:
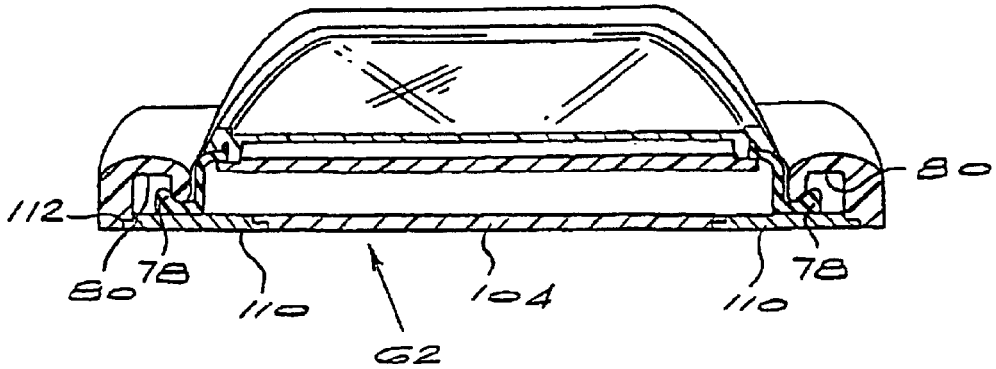
FIG. 23 shows a view similar to FIG. 19 of the fifth embodiment.

The rear surfaces of the front plates 68 in the embodiment of FIGS. 16 to 19 are recessed at 69, in the zone bounded by the rib 76, to receive a single expanse of a suitable reflective strip. In the embodiment of FIGS. 21 to 23, the rear surface of the front reflector plate 68 is formed with ribs 114. These ribs, together with the bounding rib 76 of the front plate 68 subdivide the space between the reflector and back plate into three generally triangular zones which are isolated from one another and each of which receives a separate expanse of reflective strip. The intention is that should the reflective ability of any one expanse of strip be diminished for any reason, the other expanses of strip will still be able to provide an acceptable reflective ability. In addition it is envisaged that the ribs 114 will improve the overall strength of the reflector 67.

Figure 20:
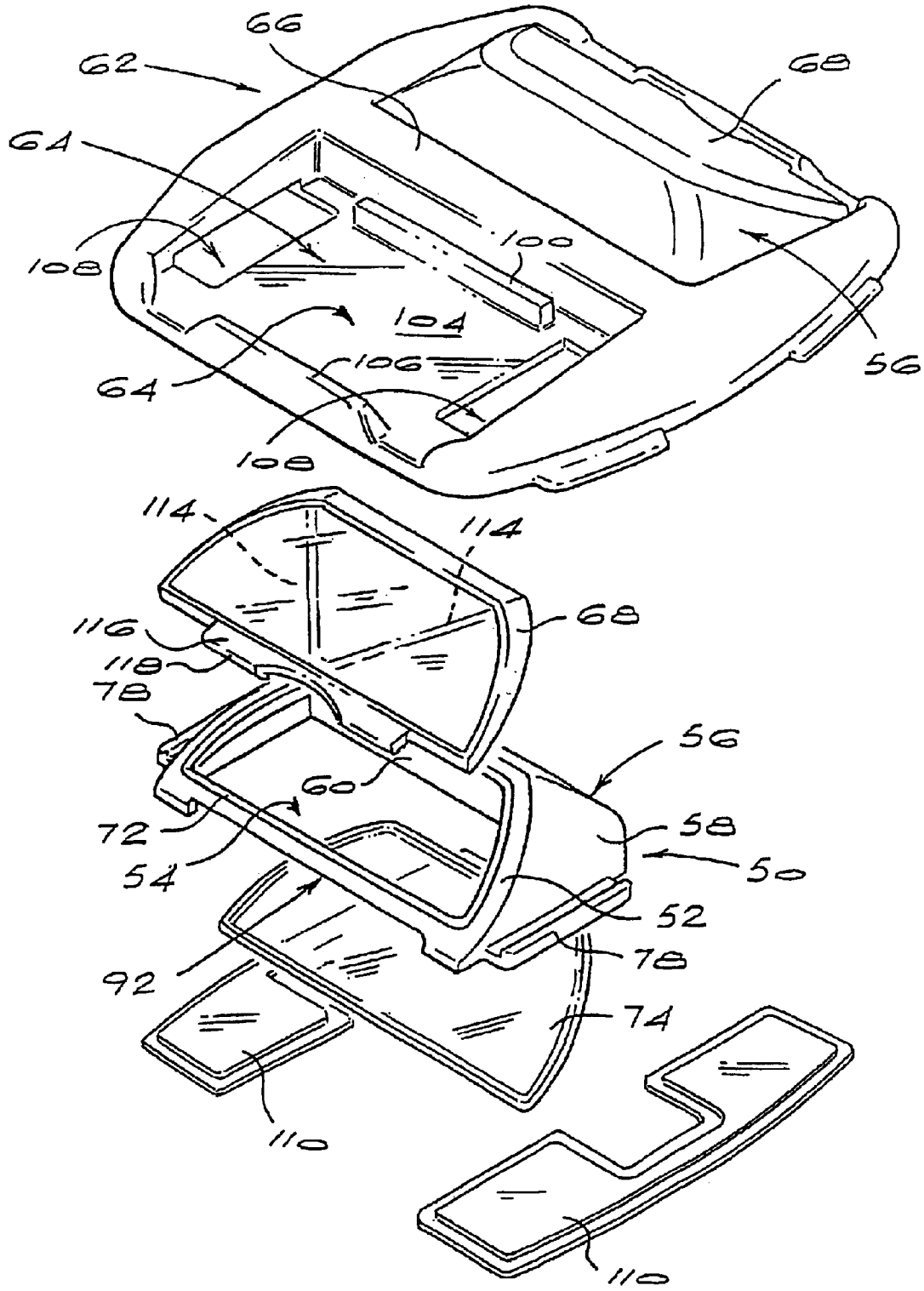
FIG. 20 shows a view similar to FIG. 16 of a fifth embodiment of the invention.

As shown in FIGS. 20 and 22, the leading edges of the front plates 68 carry projections 116 with rounded extremities 118. In the assembled road marker, these extremities butt up against the abovementioned ribs 106. In operation, when a vehicle passes over the road marker and the reflectors 67 are pushed downwardly the extremities 118 are able to pivot against the ribs 106. The abutment between the extremities 118 and the ribs 106 accordingly provide pivot points accommodating up and down pivotal movements of the reflectors.

Figure 17:
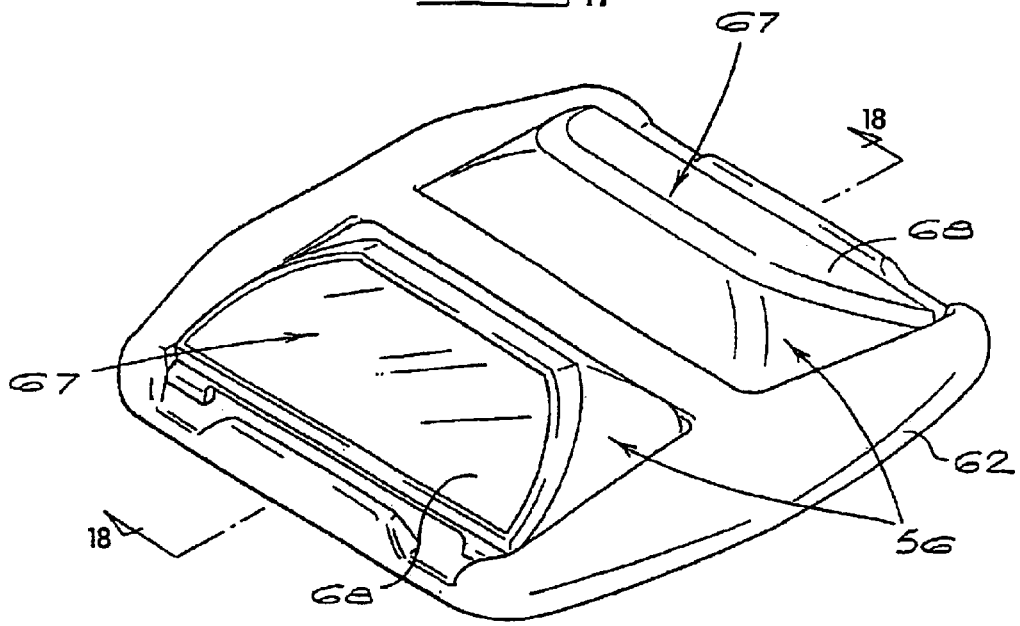
FIG. 17 shows a perspective view of the fourth embodiment in an assembled condition.
Figure 18:
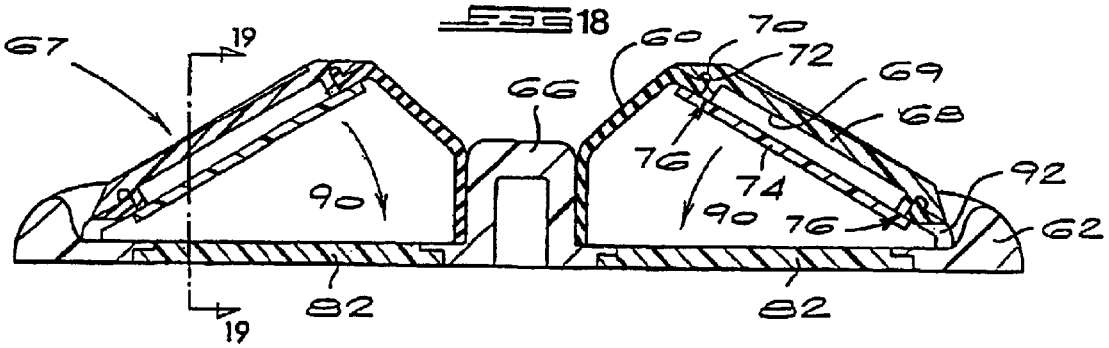
FIG. 18 shows a cross-section at the line 18—18 in FIG. 17.

Apart from the features noted above the road marker illustrated in FIGS. 19 to 23 operates in a fashion similar to that of FIGS. 16 to 19. It will be understood that in both these embodiments one of the openings 64 can be closed completely in situations where a single reflector facing in one direction only is required. This is achieved by means of a suitably shaped polycarbonate closure element (not shown) located over the opening and ultrasonically welded in place.

In both the fourth and fifth embodiments, the upper and side edges of each reflector 68 are bounded by a ridge 71 which strengthens these edges.

What is claimed:

1. A surface-mounted road marker comprising a rigid base having a generally flat underside which can be adhered to the surface of a road, at least one rigid light reflector and a resilient diaphragm which supports the light reflector resiliently at an acute angle to the road surface, the diaphragm being of upwardly tapering shape and having an opening in a front wall thereof in which the reflector is anchored, the diaphragm being resiliently deformable to allow pivotal deflection of the reflector towards the base in response to passage of a vehicle tire over the road marker, the base being continuous beneath the reflector and diaphragm such that the diaphragm forms, with the reflector and base, a hollow enclosure.

2. A road marker according to claim 1, wherein the diaphragm has an open bottom, spaced apart front and rear walls and spaced apart side walls, the side walls having lower edges carrying integral projections engaged with the base.

3. A road marker according to claim 2, wherein the projections are in the form of ribbed flanges which engage in undercut recesses in the base.

4. A road marker according to claim 1, wherein the opening in the front wall of the diaphragm is bounded by an edge and the reflector comprises a rigid front plate of light-transmitting material located over the diaphragm and a rigid rear plate located behind the diaphragm and connected to the front plate such that the edge of the opening is trapped between the plates.

5. A road marker according to claim 4, wherein the front and rear plates define a plurality of spaces between them each accommodating reflective material.

6. A road marker according to claim 5, wherein the front plate has a projection thereon which can pivot relative to an upstanding rib on the base when the reflector is deflected towards the base.

7. A road marker according to claim 1, wherein the front wall of the diaphragm is rebated to allow air to escape from the hollow enclosure when the reflector is deflected towards the base.

8. A road marker according to claim 7, wherein the base has a central, upstanding rib transverse to the direction of vehicle movement thereover and the marker comprises light reflectors supported by separate resilient diaphragms on either side of the rib with the reflectors facing in opposite directions.

9. A road marker according to claim 8, wherein the opening in the front wall of each resilient diaphragm is bounded by an edge and each reflector comprises a rigid front plate of light-transmitting material located over the associated diaphragm and a rigid rear plate located behind that diaphragm and connected to the front plate such that the edge of the opening is trapped between the plates.

* * * * *